US005368361A

United States Patent [19]

Wen-Ming

[11] Patent Number: 5,368,361

[45] Date of Patent: Nov. 29, 1994

[54] MECHANISM FOR ROCKING CHAIR

[75] Inventor: Chou Wen-Ming, Tainan, Taiwan, Prov. of China

[73] Assignee: Kung Ta Enterprise Co., Ltd., Tainan, Taiwan, Prov. of China

[21] Appl. No.: 91,791

[22] Filed: Jul. 13, 1993

[51] Int. Cl.[5] ..... A47C 3/02

[52] U.S. Cl. ..... 297/260; 297/261; 5/107; 5/109

[58] Field of Search ..... 297/260, 261; 5/105, 5/107, 108, 109

[56] References Cited

U.S. PATENT DOCUMENTS 3,019,052 1/1962 Zawadzki ..... 297/260
3,653,080 4/1972 Hafele ..... 297/260
3,886,608 6/1975 Casella ..... 297/260
4,028,753 6/1977 Rios ..... 5/109
4,775,184 10/1988 Larkin ..... 297/260
4,985,949 1/1991 Jantz ..... 5/107

*Primary Examiner*—John T. Kwon
*Attorney, Agent, or Firm*—Pro-Techtor International

[57] ABSTRACT

A mechanism for rocking a chair includes a frame disposed on a base and having a pair of racks, four wheels secured to the chair and engaged with the racks of the frame, a motor disposed on the base, a crank secured to the motor, and a lever having one end coupled to the crank and the other end coupled to the chair, the chair is driven to move in a rocking manner by the motor.

2 Claims, 2 Drawing Sheets

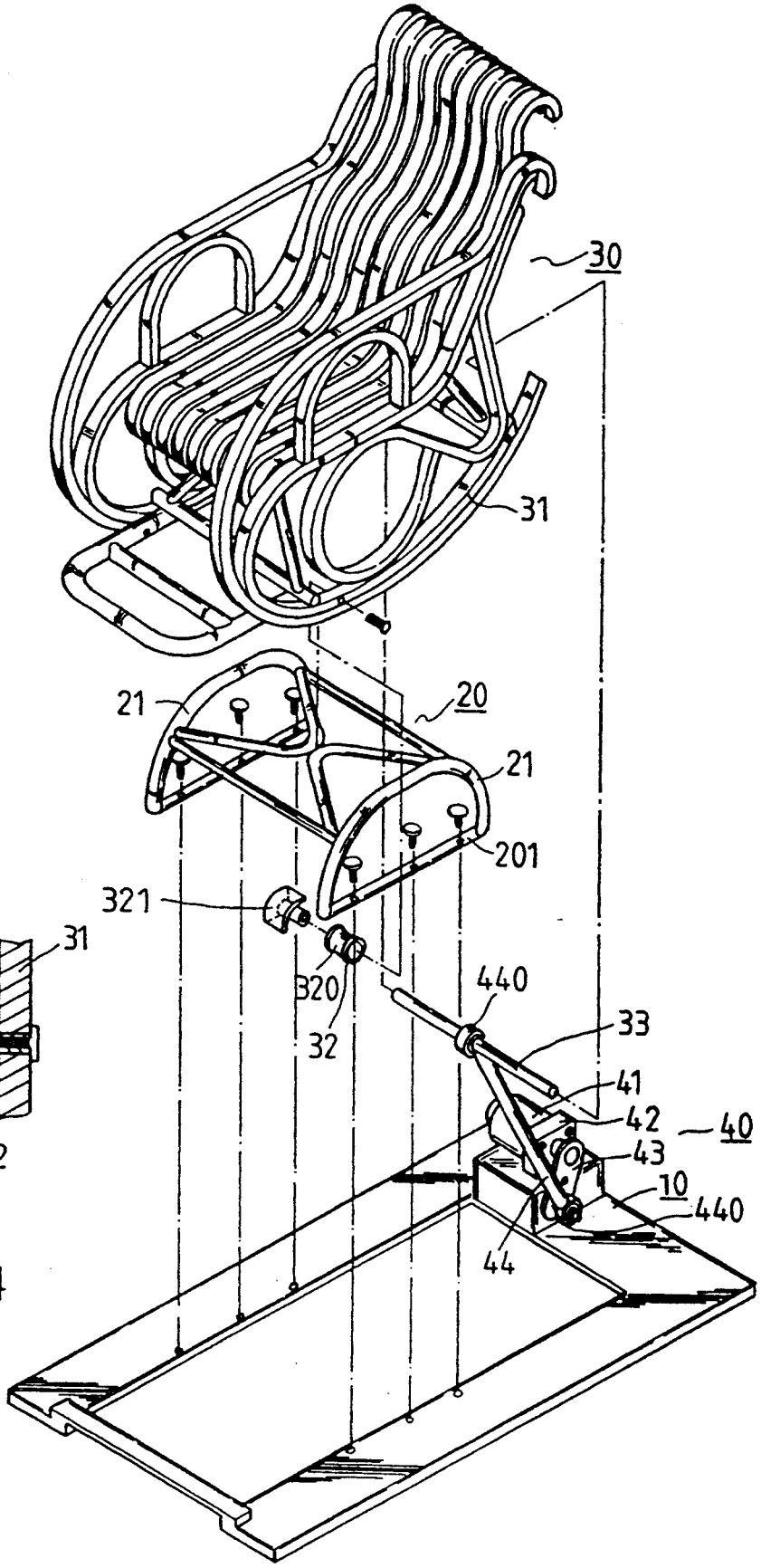
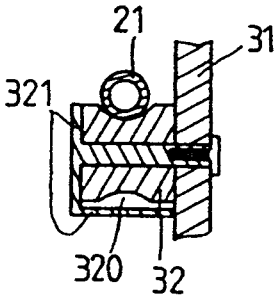
FIG4
FIG1

MECHANISM FOR ROCKING CHAIR

BACKGROUND OF THE INVENTION

1. Field of the Invention

The present invention relates to a mechanism, and more particularly to a mechanism for rocking chair.

2. Description of the Prior Art

Typical rocker chairs include a curved base, the users have to move by themselves in order to rock the chairs.

The present invention has arisen to mitigate and/or obviate the afore-described disadvantages of the conventional mechanisms for rocking chairs.

SUMMARY OF THE INVENTION

The primary objective of the present invention is to provide a mechanism for rocking the chairs.

In accordance with one aspect of the invention, there is provided a mechanism for rocking a chair comprising a base, a frame disposed on the base and including a pair of racks, four wheels secured to the chair and engaged with the racks of the frame, and means for driving the chair to move in a rocking manner.

The driving means includes a motor disposed on the base, a crank secured to the motor, and a lever having one end coupled to the crank and the other end coupled to the chair, whereby, the chair is driven to move in a rocking manner by the motor.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 1 is an exploded view of a rocker chair having a mechanism for rocking the chair in accordance with the present invention;

FIG. 4 is a cross sectional view taken along lines A—A' of FIG. 2

DETAILED DESCRIPTION OF THE PREFERRED EMBODIMENT

Figure 2:
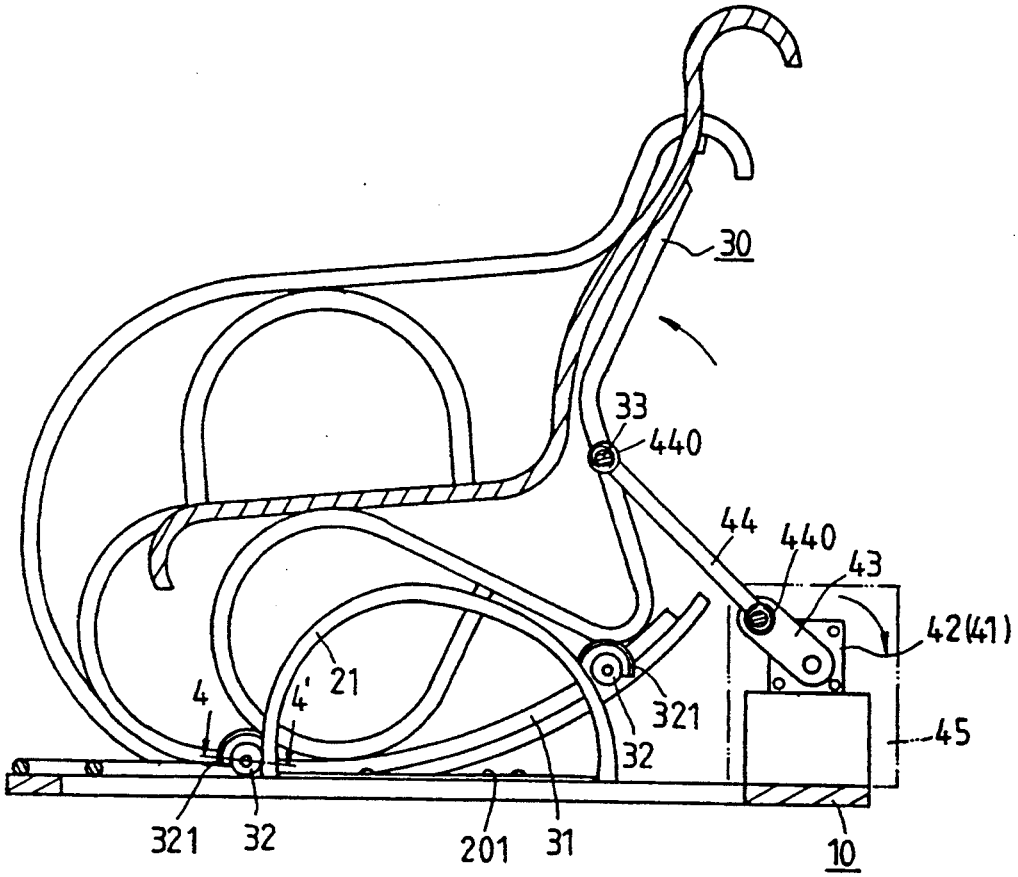
FIGS. 2 and 3 are side views of the rocker chair illustrating the operations of the rocker chair.

Referring to the drawings, and initially to FIGS. 1 and 2, a rocker chair in accordance with the present invention comprises a base 10, a frame 20 having a bottom portion 201 fixed to the base 10 and including a pair of curved racks 21 formed thereon, a rocker chair 30 including a pair of supports 31 engaged on the side portions of the frame 20, four wheels 32 each rotatably secured to the chair 30 by a bracket 321 and each having an annular groove 320 for engaging with the racks 21 of the frame 20, best shown in FIG. 4.

A driving device 40 includes a motor 41 fixed on the base 10, a gear reduction 42 secured to the motor 41, and a crank 43 having one end coupled to the gear reduction 42 or directly coupled to the shaft of the motor 41, a lever 44 having one end coupled to the crank 43 by a bearing 440 and having the other end coupled to a beam 33 by a bearing 440, the beam 33 is laterally provided in the chair. It is preferable that a housing 45 (FIGS. 2 and 3) is provided for covering the driving device 40.

Figure 3:
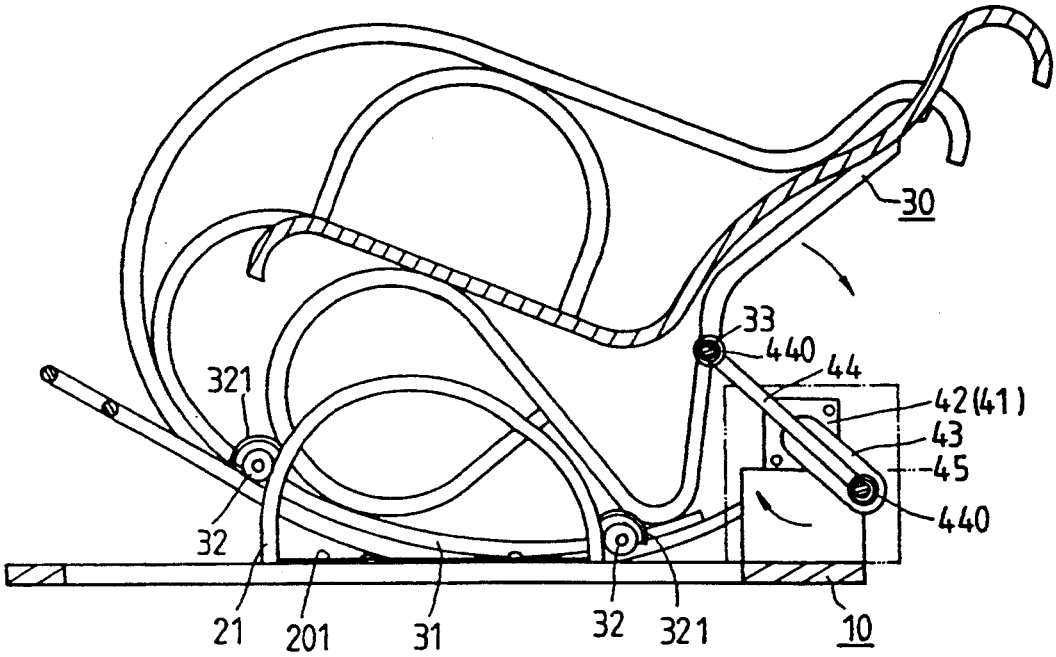

Referring next to FIGS. 2 and 3, the wheels 32 will move along the racks 21 of the frame 20, the chair 30 can be caused to move in a rocking manner by the motor 41 via the crank 43 and the lever 44.

Accordingly, the chair can be moved in a rocking way be the mechanism in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mechanism for rocking a chair comprising a base, a frame disposed on said base and including a pair of racks, four wheels secured to said chair and engaged with said racks of said frame, and means for driving said chair to move in a rocking manner.

2. A mechanism according to claim 1, wherein said driving means includes a motor disposed on said base, a crank secured to said motor, and a lever having one end coupled to said crank and the other end coupled to said chair, whereby, said chair is driven to move in a rocking manner by said motor.

* * * * *